US011723456B2

(12) United States Patent
Dart et al.

(10) Patent No.: US 11,723,456 B2
(45) **Date of Patent: *Aug. 15, 2023**

(54) ADJUSTABLE SHELF

(71) Applicant: Dedee R. Dart, Mapleton, UT (US)

(72) Inventors: Dedee R. Dart, Mapleton, UT (US); Bart Storrs, Highland, UT (US)

(73) Assignee: Dedee Dart, Mapleton, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/146,221

(22) Filed: Jan. 11, 2021

(65) Prior Publication Data

US 2021/0235862 A1 Aug. 5, 2021

Related U.S. Application Data

(63) Continuation-in-part of application No. 29/754,701, filed on Oct. 13, 2020, which is a continuation of application No. 29/689,053, filed on Apr. 26, 2019, now Pat. No. Des. 898,489.

(51) Int. Cl.
*A47B 45/00* (2006.01)
*A47B 96/02* (2006.01)

(52) U.S. Cl.
CPC ..... *A47B 45/00* (2013.01); *A47B 96/021* (2013.01)

(58) Field of Classification Search
CPC ..... A47B 45/00; A47B 96/021; A47B 96/07; A47B 96/025; A47B 77/06; A47B 57/06; A47L 19/04
USPC ..... 108/65; 211/175
See application file for complete search history.

(56) References Cited

U.S. PATENT DOCUMENTS

| | | | | |
|---|---|---|---|---|
| 774,117 | A | 11/1904 | Tandy | |
| 905,737 | A | 12/1908 | Mccombe | |
| 1,043,950 | A | 11/1912 | Martin | |
| 1,747,628 | A | 2/1930 | Hagel | |
| 2,023,901 | A | 12/1935 | Rhodes | |
| 2,122,336 | A | 6/1938 | Berry | |
| 2,216,621 | A | 10/1940 | Mackinga | |
| 2,347,821 | A | 5/1944 | Goldner | |
| 2,427,767 | A | 9/1947 | Drake | |
| 2,520,490 | A | 8/1950 | Boward | |
| 2,545,844 | A * | 3/1951 | Cougias | A47B 65/10 211/51 |
| 2,643,931 | A | 6/1953 | Anderson | |
| 2,657,810 | A | 11/1953 | Garrick | |
| 3,441,146 | A | 4/1969 | Summers | |
| 3,919,950 | A | 11/1975 | Frazelle et al. | |
| 4,025,137 | A | 5/1977 | Wyler | |
| 4,036,369 | A | 7/1977 | Eisenberg | |
| 4,155,312 | A | 5/1979 | Thorkildson | |
| 4,286,525 | A | 9/1981 | Willmore | |
| 4,469,231 | A | 9/1984 | Hehn | |
| 4,500,146 | A | 2/1985 | Peterson | |
| 4,713,949 | A | 12/1987 | Wilcox | |

(Continued)

*Primary Examiner* — Janet M Wilkens
(74) *Attorney, Agent, or Firm* — Morriss O'Bryant Compagni Cannon, PLLC

(57) ABSTRACT

An adjustable shelving system comprised of a plurality of interconnecting shelf sections including a front side shelf section, a right side shelf section and a left side shelf section. At least one of the three shelf sections is independently adjustable in length to adjust a length and/or width of the shelving system and are supported by legs that are also independently adjustable in height.

30 Claims, 9 Drawing Sheets

(56) References Cited

U.S. PATENT DOCUMENTS

| | | | | |
|---|---|---|---|---|
| 4,760,800 | A | 8/1988 | Hanson | |
| 4,975,997 | A | 12/1990 | Misiura et al. | |
| 5,080,320 | A * | 1/1992 | Chieng | B41J 29/06 248/676 |
| D332,717 | S | 1/1993 | Wolfe, III | |
| 5,291,700 | A | 3/1994 | Chew | |
| 5,339,747 | A | 8/1994 | Epps | |
| 5,415,472 | A | 5/1995 | Brise | |
| D365,465 | S | 12/1995 | Kniefel et al. | |
| 5,478,145 | A | 12/1995 | Kamachi | |
| D372,822 | S | 8/1996 | OBrien | |
| 5,564,962 | A | 10/1996 | Navarrete Espinosa | |
| 5,595,126 | A | 1/1997 | Yeh | |
| 5,628,257 | A | 5/1997 | Conner et al. | |
| 5,628,527 | A | 5/1997 | Olson et al. | |
| D393,316 | S | 4/1998 | Simon | |
| D398,458 | S | 9/1998 | Martell | |
| 5,964,360 | A | 10/1999 | Hwang | |
| 5,971,165 | A | 10/1999 | Levins | |
| 6,019,331 | A | 2/2000 | Hoogland et al. | |
| 6,036,286 | A | 3/2000 | Krumholz | |
| D423,840 | S | 5/2000 | Carville et al. | |
| 6,085,668 | A | 7/2000 | Kanki | |
| 6,142,316 | A | 11/2000 | Harbour et al. | |
| 6,142,321 | A * | 11/2000 | West | A47B 45/00 211/175 |
| D443,434 | S | 6/2001 | Tinsley | |
| 6,450,349 | B2 | 9/2002 | Lee | |
| D474,920 | S | 5/2003 | Holt | |
| 6,591,762 | B1 | 7/2003 | Haghayegh | |
| 6,623,956 | B1 | 9/2003 | Cecchi et al. | |
| 6,874,646 | B2 | 4/2005 | Jay | |
| D510,821 | S | 10/2005 | Madison | |
| D518,979 | S | 4/2006 | Petitclerc | |
| 7,204,569 | B2 | 4/2007 | Walburn | |
| 7,234,604 | B2 | 6/2007 | Eisele | |
| 7,237,686 | B2 | 7/2007 | Bertrand et al. | |
| D609,500 | S | 2/2010 | Fieldhouse et al. | |
| D627,989 | S | 11/2010 | Geoffrey | |
| D629,222 | S | 12/2010 | Kay | |
| D629,627 | S | 12/2010 | Mylet | |
| D630,459 | S | 1/2011 | Millspaugh | |
| 7,987,799 | B2 | 8/2011 | Lange et al. | |
| D652,222 | S | 1/2012 | Edwards | |
| 8,316,486 | B2 | 11/2012 | Tipperreiter | |
| 8,333,158 | B2 | 12/2012 | Wise | |
| D677,478 | S | 3/2013 | Edwards et al. | |
| D677,960 | S | 3/2013 | Kullman | |
| D678,887 | S | 3/2013 | Stravitz | |
| D691,404 | S | 10/2013 | Baum | |
| D696,540 | S | 12/2013 | Dart et al. | |
| D698,163 | S | 1/2014 | Edwards | |
| D710,980 | S | 8/2014 | Pollard, Jr. | |
| D716,065 | S | 10/2014 | Hubbard, Jr. | |
| 9,010,010 | B2 * | 4/2015 | Dreiband | F41A 35/00 42/98 |
| 9,010,552 | B2 | 4/2015 | Dart et al. | |
| D746,087 | S | 12/2015 | Dart et al. | |
| 9,198,513 | B2 | 12/2015 | Dart et al. | |
| 9,220,341 | B2 | 12/2015 | Dart et al. | |
| 9,335,089 | B1 | 5/2016 | Gossens | |
| D778,648 | S | 2/2017 | Johnson et al. | |
| D785,386 | S | 5/2017 | Flaherty et al. | |
| 9,717,337 | B2 | 8/2017 | Dart et al. | |
| D832,623 | S | 11/2018 | Flaherty et al. | |
| D834,862 | S | 12/2018 | Dart et al. | |
| D898,489 | S | 10/2020 | Dart et al. | |
| D899,159 | S | 10/2020 | Dart et al. | |
| 10,881,198 | B1 | 1/2021 | Chaoyi | |
| D932,818 | S | 10/2021 | Dart et al. | |
| D933,404 | S | 10/2021 | Dart et al. | |
| D943,314 | S | 2/2022 | Guzman | |
| 2001/0052505 | A1 | 12/2001 | Lee | |
| 2004/0094143 | A1 | 5/2004 | Bartley | |
| 2004/0159622 | A1 | 8/2004 | Craft et al. | |
| 2004/0164655 | A1 | 8/2004 | Wood et al. | |
| 2006/0207957 | A1 | 9/2006 | Chen | |
| 2008/0053940 | A1 | 3/2008 | Whalen et al. | |
| 2009/0230070 | A1 | 9/2009 | Anderson et al. | |
| 2010/0264104 | A1 | 10/2010 | Winter | |
| 2012/0037583 | A1 | 2/2012 | Wise | |
| 2012/0180302 | A1 | 7/2012 | Lopez, Jr. | |
| 2012/0223038 | A1 | 9/2012 | Bean | |
| 2015/0068999 | A1 | 3/2015 | Dart et al. | |
| 2016/0106210 | A1 | 4/2016 | Kassanoff et al. | |
| 2016/0146531 | A1 | 5/2016 | Gossens | |
| 2016/0206090 | A1 | 7/2016 | Feeley et al. | |
| 2018/0132608 | A1 | 5/2018 | Benden | |
| 2018/0279773 | A1 | 10/2018 | Rink et al. | |
| 2019/0328129 | A1 | 10/2019 | Namala | |
| 2020/0093259 | A1 | 3/2020 | Verhappen | |
| 2020/0146440 | A1 | 5/2020 | Fogarty et al. | |
| 2021/0235862 | A1 | 8/2021 | Dart et al. | |

* cited by examiner

ADJUSTABLE SHELF

CROSS-REFERENCE TO RELATED APPLICATION

This application is a continuation-in-part of U.S. Design Patent application No. 29/754,701 filed on Oct. 13, 2020, which is a continuation of U.S. Design Patent application No. 29/689,053 filed on Apr. 26, 2019, the entirety of each of which is incorporated by this reference.

BACKGROUND

Field of the Invention

The present invention relates generally to shelves. More specifically, the present invention relates to an improved adjustable shelf to be used in upper and lower cabinets, cupboards, pantries, and the like.

State of the Related Art

In kitchens, storage cabinets, pantries and the like, one often must store numerous jars, cans, bottles, boxes and/or other containers of various shapes and sizes for various uses, whether that be for cleaning, cooking, laundry or the like. In common cabinets, there is no way to store these containers without wasting a significant amount of space above the container or attempting to stack the containers vertically in a haphazard fashion (which even then often results in empty space above the two stacked containers). Additionally, the depth of most common cabinets makes it difficult to reach containers stored in the back of the cabinet. This is especially true for lower cabinets, such as those supporting a kitchen or bathroom sink. Especially in those instances, the location of water pipes, drain pipes, garbage disposals and the like interfere with the positioning and storage of items placed within the lower cabinet.

To further compound this problem, it is common for small items and containers to be stored in the same cabinet with taller items and containers. This type of storage makes it easy for the small items and containers to become blocked from view when positioned behind taller items or containers. Because of these problems, it is difficult to visually inspect what items or containers may be present in a cabinet, often resulting in purchases of duplicate products because the same product was hidden from view in the cabinet.

Most modern cabinets are provided with rectangular shelves that are adjustable to various heights. If such a shelf is adjusted to decrease the space between the bottom of the cabinet or between an adjacent lower shelf so as to not sacrifice space when storing small containers, this still has the undesired effect of visually obscuring containers that may be positioned toward the back of the cabinet making them harder to locate. If small items or containers are stored on a lower shelf, any item or container not positioned toward the front of the shelf may be hidden from view. In addition, an item or container positioned toward the back of the cabinet may be more difficult to retrieve when needed (a person needing to move items or containers in front of a desired item or container out of the cabinet to locate the desired item or container in order to reach it). This can be time consuming and frustrating when trying to locate one or more desired items or containers.

Various devices have been used to attempt to solve these problems. For example, spice racks and terraced telescopic storage shelves have become common. However, these racks often take up a significant amount of counter space. Even if they can be placed in the cupboard, they typically only allow containers of one predetermined sized to be placed in them. Most designs, such as U.S. Pat. No. 7,237,686 are not adjustable, and thus do not maximize the storage potential of an individual cupboard or cabinet. Other designs, such as U.S. Pat. No. 4,025,137, use telescoping portions to adjust to the size of the cupboard. However, this design also leaves a significant amount of wasted spaced and is not completely planar or flat when expanded as it forms a ridge where the two sections overlap. None of the foregoing designs allow the user to easily adjust the shelf to fit in different sized cabinets, are both easy to manufacture and install, and maximize the potential to store various containers of varying shapes and sizes in an accessible manner.

One attempt in the art to address the foregoing shortcomings is shown and described in U.S. Pat. No. 9,010,552 to Dart et al., which discloses a U-shaped adjustable shelving system comprised of a plurality of interconnecting shelf sections including a back shelf section, a right side shelf section and a left side shelf section. The right and left side shelf sections are coupled to the back shelf section with a sliding dovetail arrangement so as to allow adjustment of the right and left side shelf sections relative to the back shelf section in order to change the width of the adjustable shelving system. The back shelf section is adjustable in length to substantially match the width of the space in which the shelving system is to be installed. The adjustable shelving system includes support risers for self-supporting the shelving system above a surface. The adjustable shelf can be easily installed into a variety of cabinets, and allows access to small containers, such as those for herbs and spices.

There exists in the art a need for an improved adjustable shelf that allows for adjustment without the need to discard portions of the unit in order to adjust the size of the shelf. In addition, the improved adjustable shelf should be simple in construction, and easy to manufacture and install in existing cupboards and cabinets. The shelf should allow for quick adjustment to various sizes. Also, the improved adjustable shelf should make the most of the storage space, utilizing space, which is otherwise wasted or inaccessible.

SUMMARY OF THE INVENTION

Accordingly, the present invention provides an improved adjustable shelf that is capable of being used in an existing cabinet or the like. According to one aspect of the invention, the improved adjustable shelf is U-shaped and includes a left side shelf, a right side shelf, and a back or front side shelf (depending on placement within a cabinet), each of the left side, right side and back or front side shelves are slidably adjustable in length. According to another aspect of the present invention an improved adjustable shelf is provided which may be configured for engagement inside an upper or lower cabinet, and which is simple in construction allowing for easy manufacturing.

In one embodiment, an adjustable shelf system comprises a first shelf section comprised of a first L-shaped portion having a first leg and a second leg and a first adjustable portion interconnected to the first leg of the first shelf section to form a first slidable connection. Sliding the first adjustable portion relative to the first leg of the first L-shaped portion adjusts a length of the first shelf section. A second shelf section comprised of a second L-shaped portion having a first leg and a second leg and a second adjustable portion interconnected to the first leg of the second shelf section to form a second slidable connection. Similarly, sliding the second adjustable portion relative to the first leg of the second L-shaped portion adjusts a length of the second shelf section. The second leg of the first L-shaped portion interconnected to the second leg of the second L-shaped portion to form a third shelf section. Sliding the second leg of the first L-shaped portion relative to the second leg of the second L-shaped portion adjusts a length of the third shelf section.

The first, second and third shelf sections together may form a U-shaped shelf.

A plurality of legs attached to an underside of the shelf, each of the plurality of legs being adjustable in height.

In another embodiment, the first adjustable portion is comprised of a first base portion from which a first plurality of fingers depend and the first leg of the first L-shaped portion defines a first plurality of channels, each configured to receive one of the first plurality of fingers to form the first slidable connection when the first plurality of fingers are inserted into the first plurality of channels.

In yet another embodiment, the second adjustable portion is comprised of a second base portion from which a second plurality of fingers depend and the first leg of the second L-shaped portion defines a second plurality of channels, each configured to receive one of the second plurality of fingers to form the second slidable connection when the second plurality of fingers are inserted into the second plurality of channels.

In still another embodiment, the first adjustable portion and the second adjustable portion are identically configured.

In yet another embodiment, the second leg of the first L-shaped portion defines a third plurality of channels and the second leg of the second L-shaped portion comprises a third plurality of fingers, the third plurality of channels each configured to receive one of the third plurality of fingers to form the third slidable connection when the third plurality of fingers are inserted into the third plurality of channels.

In another embodiment, each of the plurality of legs are comprised of first and second leg portions, the first and second leg portions connected in a telescopic manner to allow adjustment of height of each of the plurality of legs.

In still another embodiment, a first leg of the plurality of legs is attached to an underside of the first adjustable portion, a second leg of the plurality of legs is attached to an underside of the second adjustable portion, a third leg of the plurality of legs is attached to an underside of the first L-shaped portion and a fourth leg of the plurality of legs is attached to an underside of the second L-shaped portion.

In another embodiment, each of the first leg portions form a crescent shaped tube defining an opening within which a lower extending portion of each of the second leg portions is insertable.

In yet another embodiment, each of the first leg portions include a self-biasing tab and each of the second leg portions include a plurality of evenly spaced and horizontally extending slots so that when the second leg portion is inserted into the first leg portion, retraction of the tab away from the second leg portion allows the first and second leg portions to slide relative to one another and releasing the tab allows the tab to engage with one of the plurality of slots such that the first leg portion is held to second leg portion by an engagement of the tab with the one of the plurality of slots.

In still another embodiment, an upper end of each of the plurality of legs is configured to mate with the U-shaped shelf by sliding engagement, wherein an upper end of each leg includes a perimeter wall that extends above a top surface of the upper end, the perimeter wall defines a channel to receive a lip of a respective shelf portion to secure the respective shelf portion to the leg.

In another embodiment, a top surface of the first L-shaped portion, including top surfaces of each portion interposed between the plurality of channels, and a top surface of the first adjustable portion, including top surfaces of each of the first plurality of fingers, are planarly aligned.

In yet another embodiment, a top surface of the second L-shaped portion, including top surfaces of each portion interposed between the second plurality of channels, and a top surface of the second adjustable portion, including top surfaces of each of the second plurality of fingers, are planarly aligned.

In still another embodiment, a top surface of the first L-shaped portion, including top surfaces of each portion interposed between the third plurality of channels, and a top surface of the second L-shaped portion, including top surfaces of each of the third plurality of fingers, are planarly aligned.

In yet another embodiment, the first L-shaped portion includes a first base plate that forms a bottom of each of the first and third plurality of channels, each of the first and third plurality of channels being rectangular in shape and each sized to receive a respective finger of the first and third plurality of fingers.

In another embodiment, each of the plurality of first, second and third channels are formed by upwardly depending walls from a respective base plate and upper surface wall sections that define slots sized and shaped to receive a top portions of each respective on of the plurality of first, second and third fingers, such that a respective top surface of each of the upper surface wall sections and top surfaces of each of the top portions of respective fingers are substantially coplanar when the fingers are inserted into respective channels.

In still another embodiment, each of the plurality of upper surface wall sections overhang one or more respective channels to define a plurality of slots between adjacent upper surface wall sections and each finger of the plurality of first, second and third fingers define stepped top portions, each stepped top portion configured to fit within a respective one of the plurality of slots so that top surfaces of the plurality of upper surface wall sections and of each of the plurality of first, second and third fingers define a substantially continuous surface along locations of finger to channel engagement.

In still another embodiment, each of the plurality of first, second and third fingers are spaced apart and aligned in parallel to match a spacing and alignment of respective first, second and third channels.

In another embodiment, at least two of each of the first, second and third plurality of fingers include downwardly depending tabs at their respective distal ends, each tab configured to engage with a corresponding bottom slot in a corresponding channel so as to form a stop when the first, second and third fingers are retracted from respective first, second and third channels.

In yet another embodiment, an adjustable shelf system is comprised of a first shelf section comprised of a first L-shaped portion having a first leg and a second leg and a second shelf section comprised of a second L-shaped portion having a first leg and a second leg, the second leg of the first L-shaped portion interconnected to the second leg of the second L-shaped portion to form a third shelf section. Sliding the second leg of the first L-shaped portion relative to the second leg of the second L-shaped portion adjusts a length of the third shelf section, the first, second and third shelf sections together forming a U-shaped shelf. The second leg of the first L-shaped portion defines a first plurality of channels and the second leg of the second L-shaped portion comprises a first plurality of fingers. The first plurality of channels is each configured to receive one of the first plurality of fingers to form a slidable connection when the first plurality of fingers are inserted into the first plurality of channels.

In yet another embodiment, an adjustable shelf system comprises a first elongate shelf section and a second elongate shelf section. The first shelf section is interconnected to the second shelf section. Sliding the first shelf section relative to the second shelf section adjusts a combined length of the first and second elongate shelf sections shelf section. The first elongate shelf section defines a first plurality of channels and the second elongate shelf section comprises a first plurality of fingers. The first plurality of channels is each configured to receive one of the first plurality of fingers to form a slidable connection when the first plurality of fingers are inserted into the first plurality of channels.

These and other aspects of the present invention may be realized in an improved adjustable shelf which may be used to store containers and the like of various shapes and sizes as shown and described in the following figures and related description.

BRIEF DESCRIPTION OF THE DRAWINGS

When considered in connection with the following illustrative figures, a more complete understanding of the present invention may be derived by referring to the detailed description. In the figures, like reference numbers refer to like elements or acts throughout the figures. Various embodiments of the present invention are shown and described in reference to the numbered drawings wherein.

Figure 1:
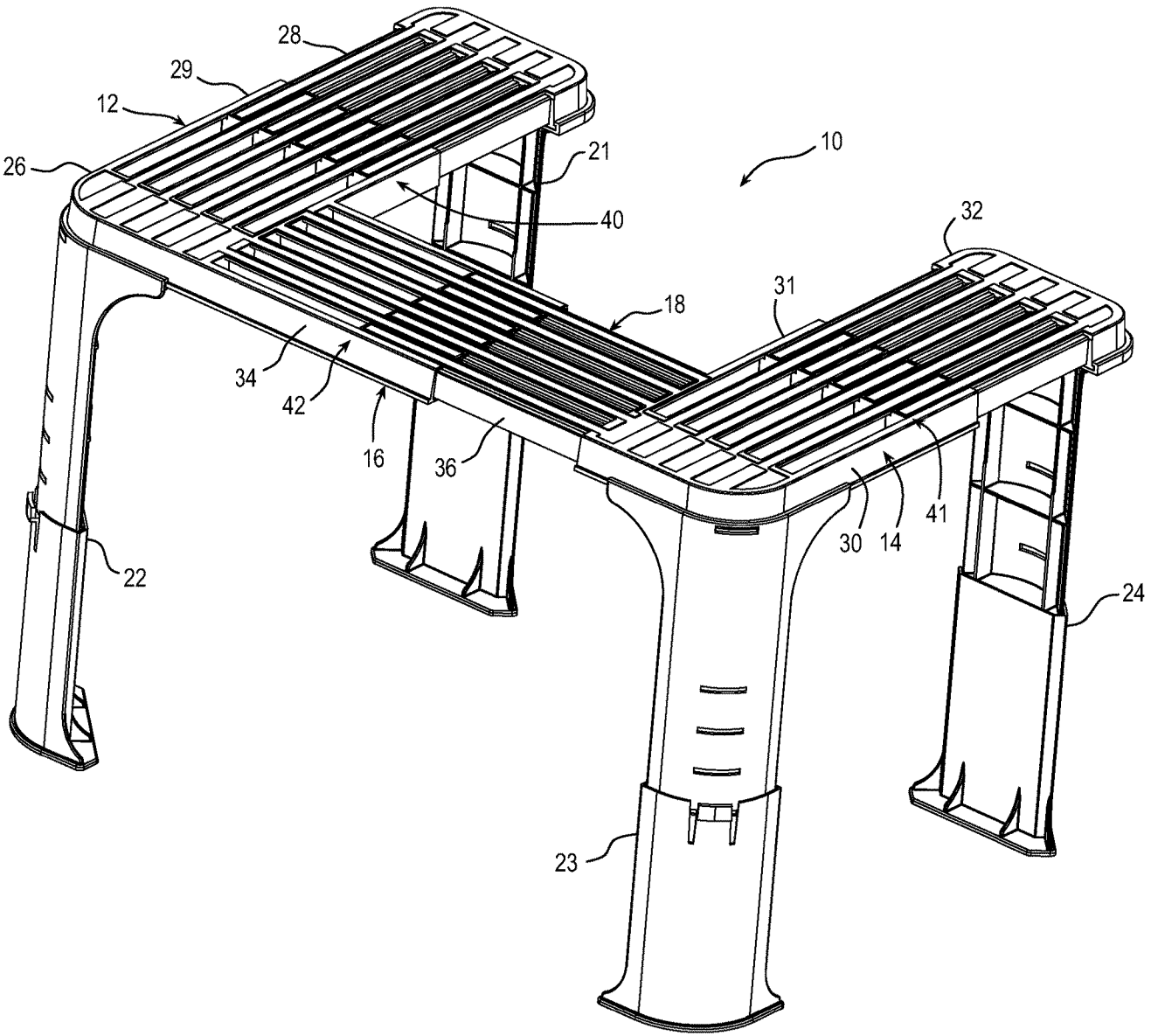
FIG. 1 is a perspective top side view of a first embodiment of an adjustable shelf according to the present invention.

It will be appreciated that the drawings are illustrative and not limiting of the scope of the invention, which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention. Elements and acts in the figures are illustrated for simplicity and have not necessarily been rendered according to any particular sequence or embodiment.

DETAILED DESCRIPTION OF THE ILLUSTRATED EMBODIMENTS

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims. Unless specifically noted, it is intended that the words and phrases in the specification and the claims be given their plain, ordinary, and accustomed meaning to those of ordinary skill in the applicable arts. It is noted that the inventor can be his own lexicographer. The inventor expressly elects, as her own lexicographer, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventor's intent and desire that the simple, plain and ordinary meaning to the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of 35 U.S.C. § 112(f). Thus, the use of the words "function," "means" or "step" in the Detailed Description of the Invention or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for" and the specific function (e.g., "means for filtering"), without also reciting in such phrases any structure, material or act in support of the function. Thus, even when the claims recite a "means for . . . " or "step for . . . " if the claims also recite any structure, material or acts in support of that means or step, or that perform the recited function, then it is the clear intention of the inventor not to invoke the provisions of 35 U.S.C. § 112(f). Moreover, even if the provisions of 35 U.S.C. § 112(f) are invoked to define the claimed inventions, it is intended that the inventions not be limited only to the specific structure, material or acts that are described in the illustrated embodiments, but in addition, include any and all structures, materials or acts that perform the claimed function as described in alternative embodiments or forms of the invention, or that are well known present or later-developed, equivalent structures, material or acts for performing the claimed function.

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. Thus, the full scope of the inventions is not limited to the examples that are described below.

FIG. 1 shows a perspective view of an adjustable shelf, generally indicated at 10. The adjustable shelf 10 is comprised of a first shelf section 12 and a second shelf section 14 that are interconnected to one another to form a third shelf section 16, the first, second and third shelf sections 12, 14 and 16 forming a U-shaped shelf 18. The first, second and third shelf portions 12, 14 and 16 are each adjustable in their respective lengths and are supported by four adjustable legs 21-24. The legs 21-24 are each vertically adjustable to provide height adjustment of the U-shaped shelf 18 relative to a support surface upon which the legs 21-24 may rest. The adjustable shelf 10 may be formed from molded plastic, wood, composite materials, or other appropriate materials, which will be known to those of skill in the art in light of the present disclosure.

The first shelf section 12 is comprised of a first L-shaped portion 26 and a first adjustable portion 28 interconnected and slidable to a first leg 29 the L-shaped portion 26, whereby sliding the first adjustable portion 28 relative to the first L-shaped portion 26 adjusts the overall length of the first shelf section 12. Likewise, the second shelf section 14 is comprised of a second L-shaped portion 30 and a second adjustable portion 32 interconnected and slidable relative to a first leg 31 of the second L-shaped portion 30, whereby sliding the second adjustable portion 32 relative to the second L-shaped portion 30 adjusts the overall length of the first shelf section 14. The second legs 34 and 36 of the first and second L-shaped portions 26 and 30, respectively, are interconnected in a slidable manner to form the third shelf section 16. When the first and second shelf sections 12 and 14 are moved toward or away from one another, the length of the shelf section 16 is adjusted. As will be described in more detail, the slidable connections 40, 41 and 42 of the of the shelf sections 12, 14 and 16, respectively, are formed by a plurality of interlocking fingers and channels interposed between and slidable relative to one another, the top surfaces of which form respective top surfaces of the shelf sections 12, 14 and 16. This interconnecting and slidable connection allows for length adjustments of each shelf section 12, 14 and 16 without the need to physically alter a shelf section (as by removing one or more portions of one or more shelf sections) to adjust a length of the shelf section. Additionally, the ability to adjust the length of each shelf section 12, 14 and 16 from long to short and back to long allows for size adjustment of the adjustable shelf 10 as needs change or if the adjustable shelf 10 is to be moved to another location where size adjustment is necessary or desired.

Figure 2:
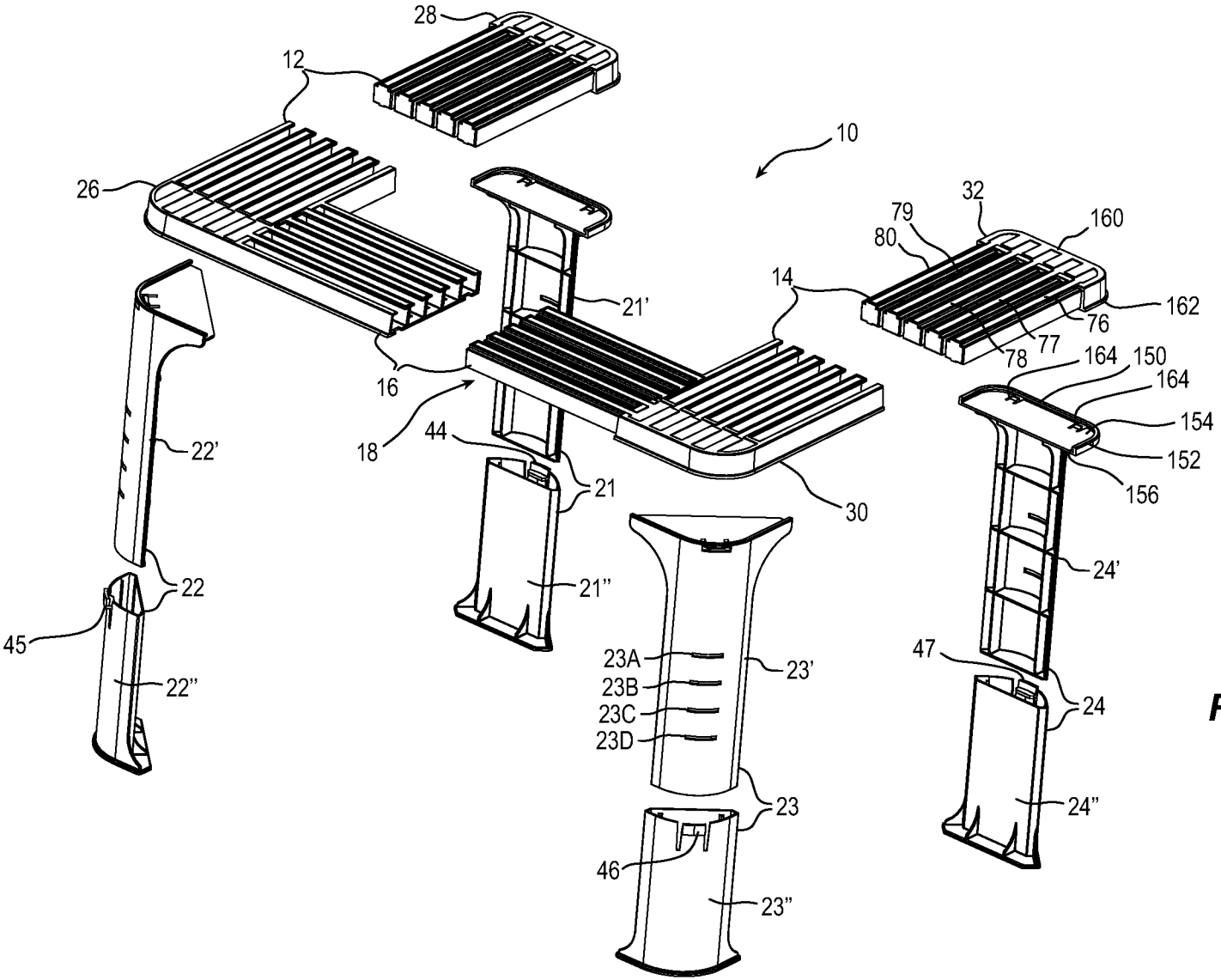
FIG. 2 is a perspective top side exploded view of the adjustable shelf shown in FIG. 1.

FIG. 2 illustrates an exploded view of the adjustable shelf 10 of FIG. 1. As noted above, the adjustable shelf 10 is comprised of a first shelf section 12, comprised of an L-shaped section 26 and a shelf expansion portion 28, and a second shelf section 14, comprised of another L-shaped section 30 and another shelf expansion portion 32. The shelf expansion portions 28 and 32 are identical in configuration so as to be interchangeable and so as to be manufacturable from the same mold or molds as the case may be. The two L-shaped sections 26 and 30 are configured to engage one another in a slidable manner with the interconnection of the L-shaped sections 26 and 30 forming the shelf portion 16 when combined. Thus, when second shelf section 14 is coupled to the first shelf section 12, the interconnection forms the third shelf portion 16, with third shelf section 16, the first shelf section 12 and the second shelf section 14 together forming the U-shaped shelf 18 shown in FIG. 1.

The first shelf section 12 comprised of shelf portions 26 and 28 are supported by legs 21 and 22. Leg 21 is comprised of two leg portions 21' and 21". The leg portions 21' and 21" are combinable in a telescopic manner such that a length of the leg 21 is adjustable. Likewise, the leg 22 is comprised of two leg portions 22' and 22". The leg portions 22' and 22" are also combinable in a telescopic manner such that a length of the leg 22 is adjustable.

Similarly, the second shelf section 14 comprised of shelf portions 30 and 32 are supported by legs 23 and 24. Leg 23 is comprised of two leg portions 23' and 23". The leg portions 23' and 23" are combinable in a telescopic manner such that a length of the leg 23 is adjustable. Likewise, the leg 24 is comprised of two leg portions 24' and 24". The leg portions 24' and 24" are also combinable in a telescopic manner such that a length of the leg 24 is adjustable.

Each of the lower leg portions 21", 22", 23" and 24" form a crescent shaped tube defining an opening within which the lower extending portions of the upper leg portions 21', 22', 23' and 24' can be inserted. In order to accommodate adjustment of a height of a leg, each lower leg portion 12", 22", 23" and 24" include a self-biasing tab 44, 45, 46 and 47, respectively. In addition, each of the upper leg portions 21', 22', 23' and 24' include a plurality of evenly spaced and horizontally extending slots, such as slots 23A, 23B, 23C and 23D. When the upper leg portion 23' is inserted into the lower leg portion 23", retraction of the tab 46 away from the upper leg portion 23' allows the upper and lower leg portions 23' and 23" to slide relative to one another. Releasing the tab 46 allows the tab 46 to engage with one of the slots 23A, 23B, 23C and 23D such that the lower leg portion 23" is held to upper leg portion 23' by the engagement of the tab 46 with one of the slots 23A, 23B, 23C and 23D. Each of the other legs 21, 22 and 24 are similarly configured with the slots in each upper leg portion being arranged at the same height the slots 23A, 23B, 23C and 23D in upper leg portion 23'. This allows for adjustments of each of the legs 21, 22, 23 and 24 to the same height to support each of the four corners of the shelf 10 to the same height above a surface.

The upper ends of each leg 21, 22, 23 and 24 are configured to mate with and be retained relative to an underside of the U-shaped shelf 18, with one leg positioned at each of the four corners of the U-shaped shelf 18. The upper end of each leg 21, 22, 23 and 24 has a greater cross-sectional surface area than a cross sectional area of the lower end of the leg. This provides a larger surface area for supporting the shelf and for attachment of each leg 21, 22, 23 and 24 to the underside of the U-shaped shelf 18.

Each leg 21, 22, 23 and 24 is attached to the U-shaped shelf 18 by sliding engagement. For example, with reference to leg 24, the upper end 150 includes a perimeter wall 152 that extends above the top surface 154 of the upper end 150. The perimeter wall 152 defines a channel 156 that is open toward the upper surface 154. Essentially, the perimeter wall 152 is L-shaped that depends upwardly from the top surface 154 of the upper end 150 of the leg 24 and extends over the edge of the upper surface 154 to form the channel 156 therein between that extends along the perimeter of the upper end 150. The shelf expansion portion 32 comprises a base portion 160 from which each of the fingers 76-80 depend. The base portion 160 includes a lip or step protrusion 162 around its lower edge. The step protrusion 162 is sized and shaped to be received within the channel 156 defined by the wall 152 in a tongue and groove manner. The step protrusion 162 is inserted into the channel 156 until the self-biasing tabs 164 engage with a bottom edge of the shelf expansion portion 32 and hold it relative to the leg 24. This engagement of the leg 24 to the shelf expansion portion 32 secures the leg 24 to the shelf expansion portion 32. Each of the other legs 21, 22 and 23 are similarly configured so as to be attachable to the u-shaped shelf 18 at a respective corner.

Figure 3:
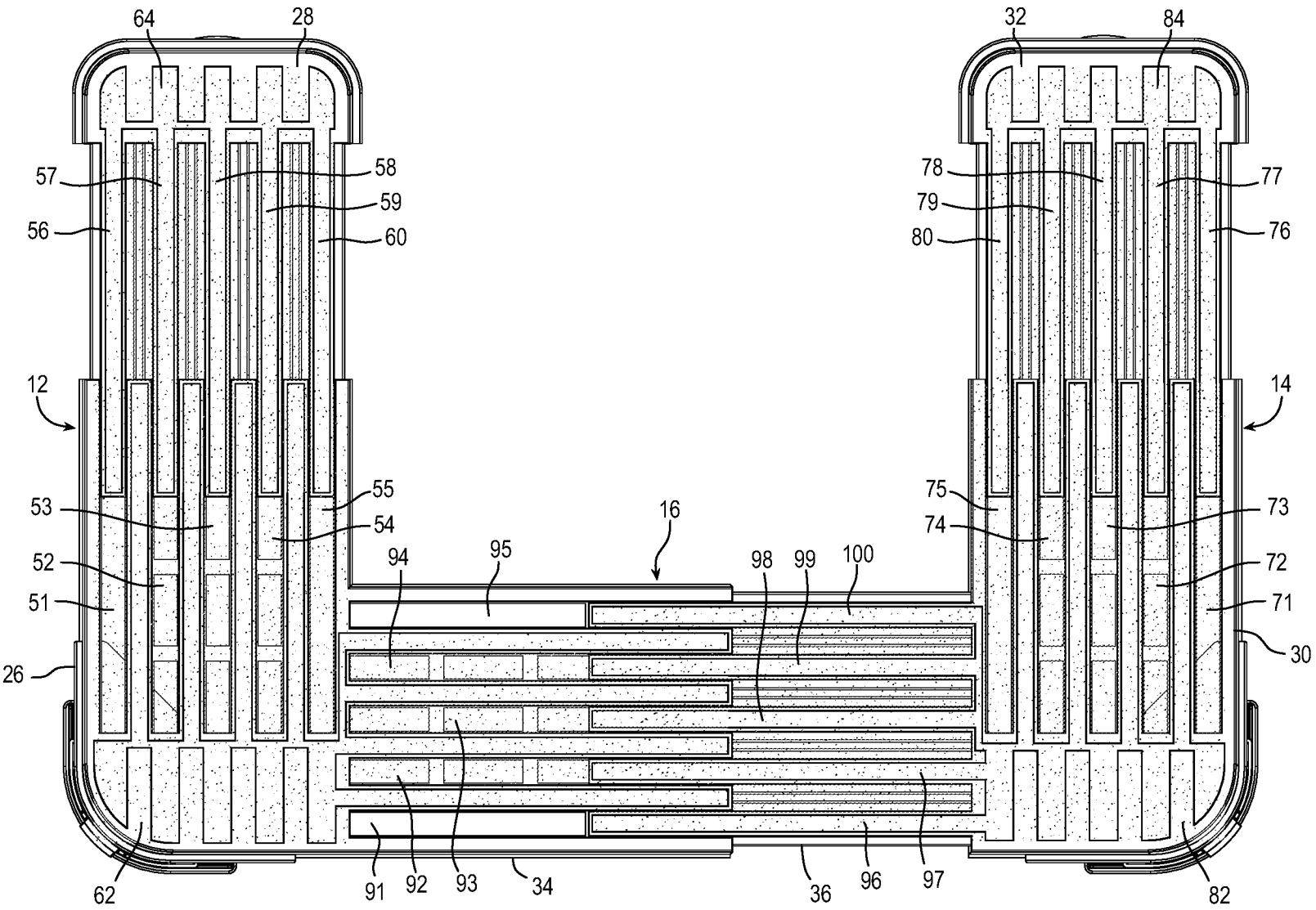
FIG. 3 is a top side plan view of the adjustable shelf shown in FIG. 1.

As shown in FIG. 3, the L-shaped portion 26 of the shelf section 12 defines a plurality of channels 51-55 sized and shaped for receiving a corresponding plurality of fingers 56-60, respectively, of the first adjustable portion 28. The top surface 62 of the L-shaped portion 26, which includes the top surfaces of each of the portions interposed between the channels 51-55, and the top surface 64 of the first adjustable portion 28, which includes the top surfaces of each of the fingers 56-60 are planarly aligned.

Similarly, the L-shaped portion 30 of the shelf section 14 defines a plurality of channels 71-75 sized and shaped for receiving a corresponding plurality of fingers 76-80, respectively, of the second adjustable portion 32. The top surface 82 of the L-shaped portion 30, which includes the top surfaces of each of the portions interposed between the channels 71-75, and the top surface 84 of the second adjustable portion 32, which includes the top surfaces of each of the fingers 76-80 are planarly aligned.

The second leg 34 of the L-shaped portion 26 defines a plurality of channels 91-95 similar to the channels 51-55 and oriented perpendicular thereto. The second leg 36 of the L-shaped portion 30 is comprised of a plurality of fingers 96-100 sized and shaped to be at least partially received within and slidably supported by the second leg 34 of the L-shaped portion 26. This engagement allows for length adjustment of the shelf section 16 by moving the L-shaped portion 26 to or away from the L-shaped portion 30 while the channels 91-95 engage the fingers 96-100.

Figure 4:
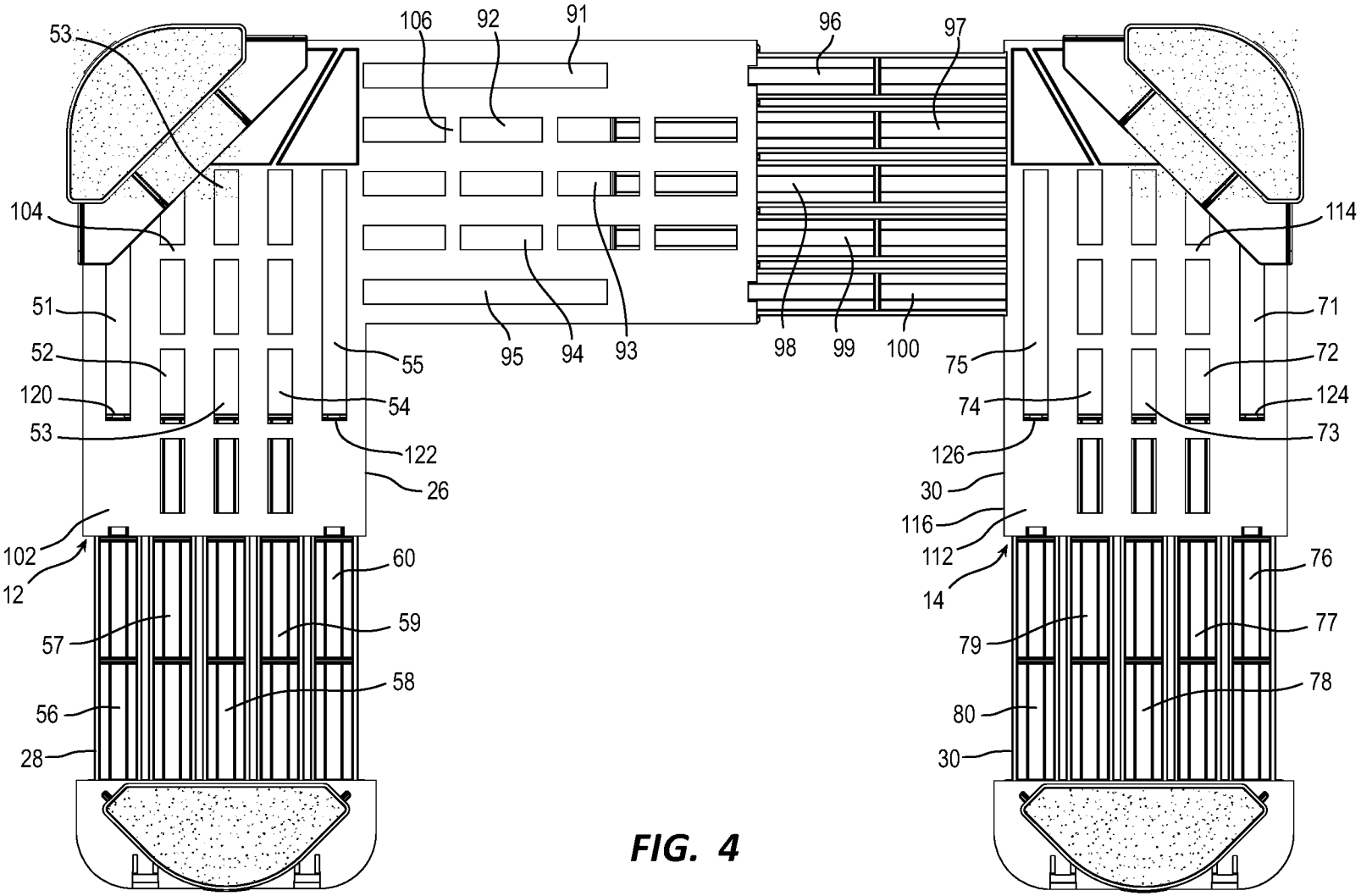
FIG. 4 is a bottom side plan view of the adjustable shelf shown in FIG. 1.

As further shown in FIG. 4, the L-shaped portion 26 includes a base plate 102 that forms the bottom of each channel 51-55 and each channel 91-95. To increase the rigidity and structural integrity of the plate 102, a plurality of cross-members, such as cross-members 104 and 106 are connected to and interposed between adjacent portions of the plate 102 forming the bottoms of the middle channels 52-54 and 92-94, respectively. Similarly, the L-shaped portion 30 includes a base plate 112 that forms the bottom of each channel 71-75. To increase the rigidity and structural integrity of the plate 112, a plurality of cross-members, such as cross-member 114 is connected to and interposed between adjacent portions of the plate 112 forming the bottoms of the middle channels 72-74. The fingers 96-100 are positioned perpendicular to and depend from the inner side 116 of the L-shaped portion 30 in a cantilever manner.

Each of the fingers 56-60 of the adjustable portion 28 are spaced apart and aligned in parallel to match the spacing and alignment of the channels 51-55. When inserted into the channels, tabs 120 and 122 that downwardly depend from the distal ends of the fingers 56 and 60, respectively, each provide a stop within the elongate openings in the bottom of channels 51 and 55 to prevent the adjustable portion 28 from being extended beyond the point at which the fingers 56-60 could be disengaged from the channels 51-55. Moreover, when the tabs 120 and 122 engage with the distal ends of the elongate openings in the bottom of channels 51 and 55, portions of the fingers 56-60 still overlap with a portion of the plate 102 so as to maintain structural integrity of the shelf section 12 when the shelf section 12 is in a fully extended position as shown.

Likewise, each of the fingers 76-80 of the adjustable portion 30 are spaced apart and aligned in parallel to match the spacing and alignment of the channels 71-75. When inserted into the channels, tabs 124 and 126 that downwardly depend from the distal ends of the fingers 76 and 80, respectively, each provide a stop within the elongate openings in the bottom of channels 71 and 75 to prevent the adjustable portion 308 from being extended beyond the point at which the fingers 56-60 could be disengaged from the channels 71-75. Moreover, when the tabs 124 and 126 engage with the distal ends of the elongate openings in the bottom of channels 71 and 75, portions of the fingers 76-80 still overlap with a portion of the plate 112 so as to maintain structural integrity of the shelf section 14 when the shelf section 14 is in a fully extended position as shown.

Figure 5:
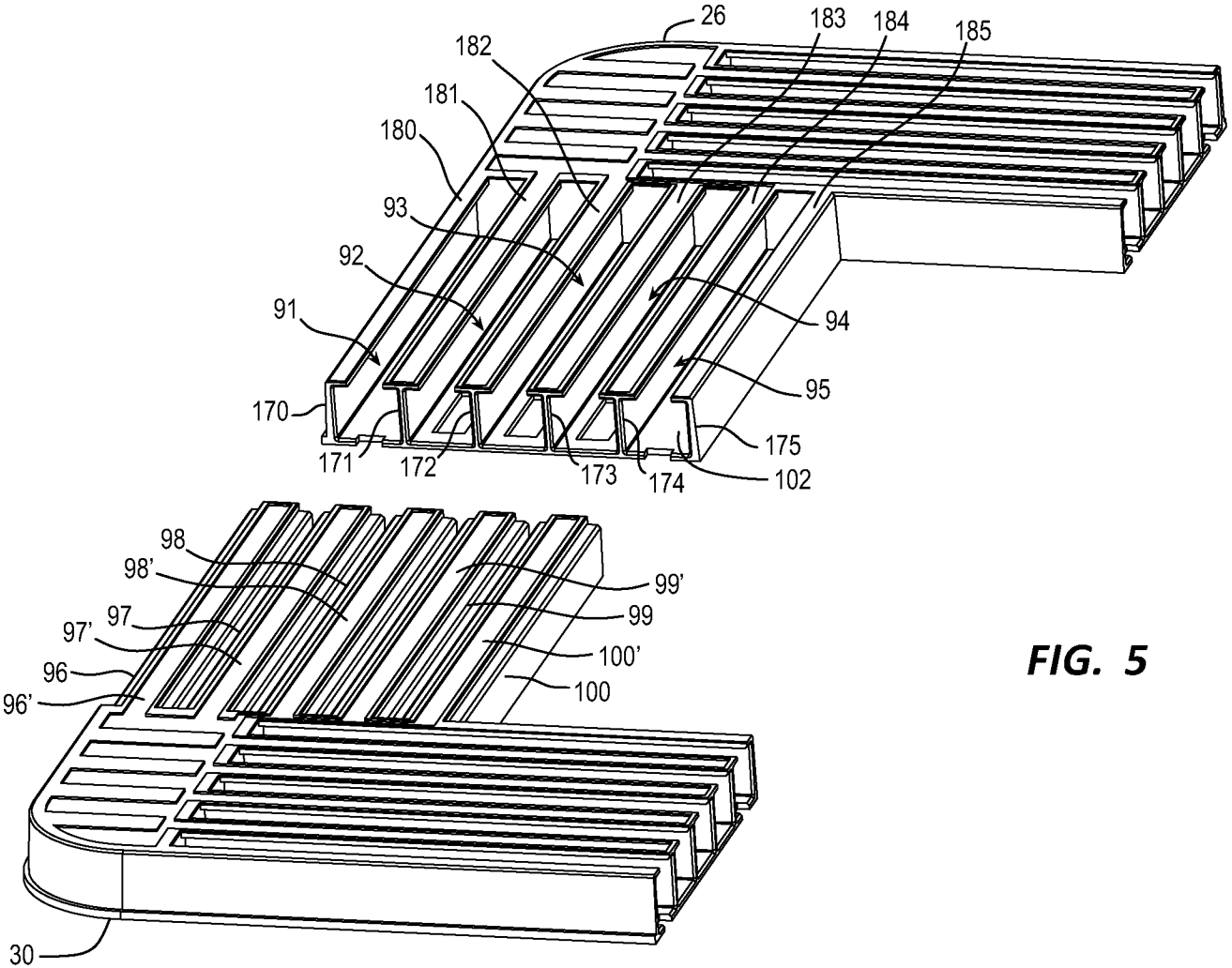
FIG. 5 is a perspective top side exploded view of two shelf sections that form parts of the adjustable shelf shown in FIG. 1.

As shown in FIG. 5, the shelf portions 26 and 30 are configured to be joined together in a sliding engagement with fingers 96-100 inserted into channels 91-95, respectively. Each finger 96-100 have a generally rectangular cross section with a raised or stepped top portion 96'-100'. Each channel 91-95 is also generally rectangular in shape, each sized to receive a respective finger 96-100 with a slight friction fit to allow sliding of the fingers 96-100 within the channels 91-95 with some resistance to moving for stability of the shelf. The channels 91-95 are defined by the base plate 102, upwardly depending walls 170-173 that form sidewalls of each channel 91-95 and upper surface wall sections 180-185 that define slots sized and shaped to receive the top portions 96'-100' such that the top surfaces of the upper surface wall sections 180-185 and the top surfaces of the top portions 96'-100' are substantially coplanar when the fingers 96-100 are inserted into the channels 91-95. Each of the upper surface wall sections 180-185 overhang one or more of respective channels 91-95. This engagement and fitting of the raised or stepped top portions 96'-100' within the slots formed between the upper surface wall sections 180-185 results in a substantially continuous surface along the locations of the finger to channel engagements.

Figure 6:
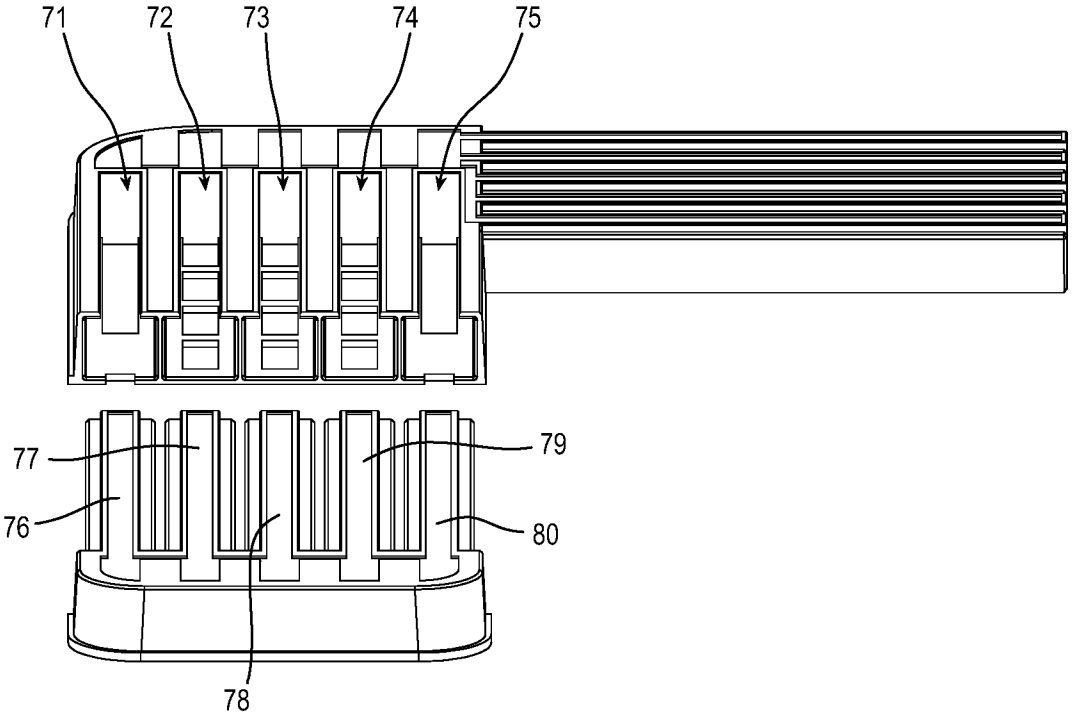
FIG. 6 is a perspective top side exploded view of two shelf sections that form parts of the adjustable shelf shown in FIG. 1.

As shown in FIG. 6, the slidable engagement of the fingers 76-80 with channels 71-75 is configured in an identical manner to the fingers 96-100 and channels 91-95 described above with reference to FIG. 5. Specifically, each finger 76-80 has a generally rectangular cross section with a raised or stepped top portion. Each channel 71-75 is also generally rectangular in shape, each sized to receive a respective finger 76-80 with a slight friction fit to allow sliding of the fingers 76-80 within the channels 71-75 with some resistance to moving for stability of the shelf. The channels 71-75 are defined by the base plate, upwardly depending walls that form sidewalls of each channel 71-75 and upper surface wall sections that define slots sized and shaped to receive the top portions such that the top surfaces of the upper surface wall sections and the top surfaces of the top portions are substantially coplanar when the fingers 76-80 are inserted into the channels 71-75. Each of the upper surface wall sections overhang one or more of respective channels 71-75. This engagement and fitting of the raised or stepped top portions within the slots formed between the upper surface wall sections results in a substantially continuous surface along the locations of the finger to channel engagements.

Figure 7:
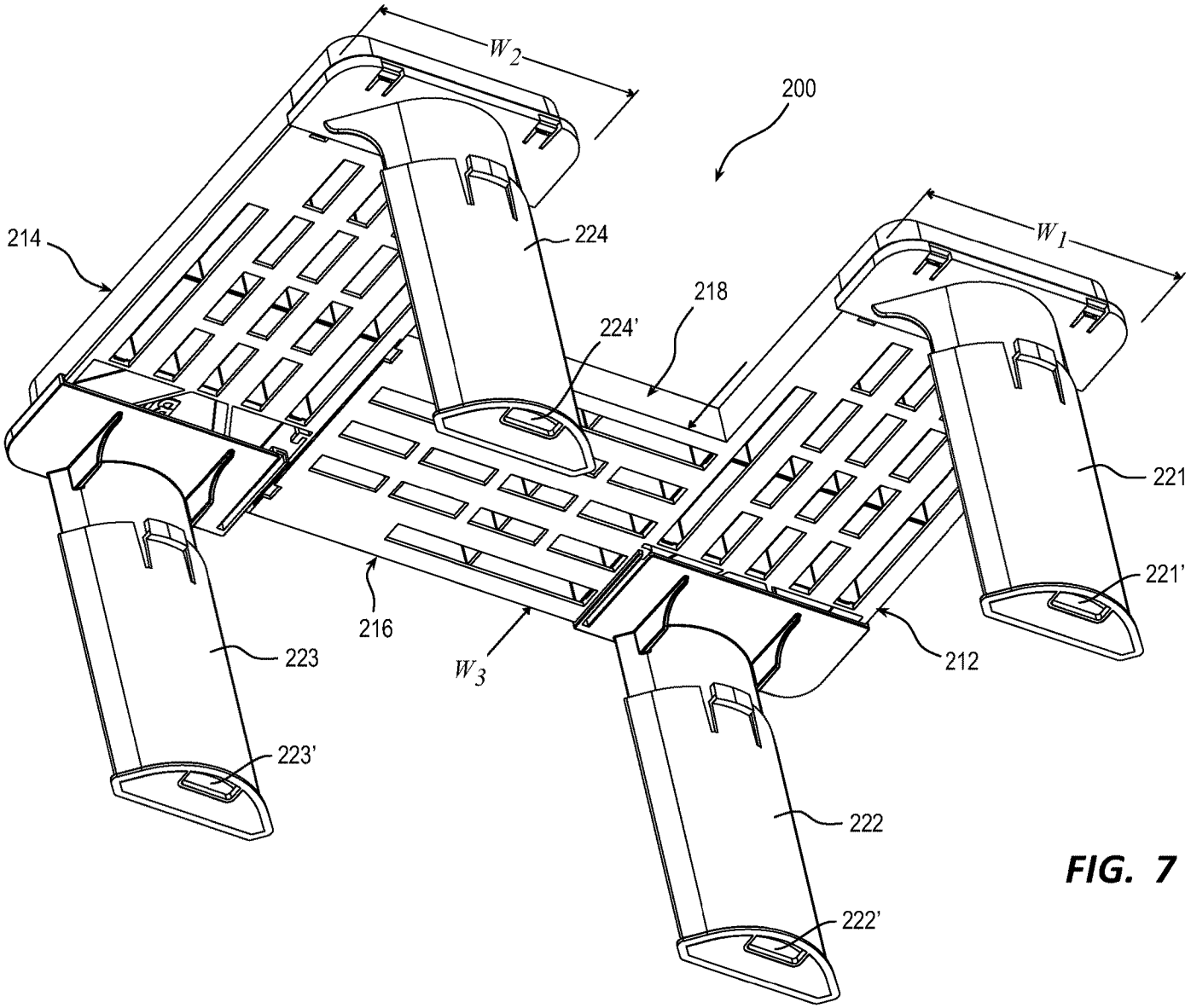
FIG. 7 is a perspective bottom side view of a second embodiment of an adjustable shelf according to the present invention.

As shown in FIG. 7, which illustrates a perspective bottom view of an adjustable shelf, generally indicated at 200. Similar to the adjustable shelf 10 shown in FIG. 1, the adjustable shelf 200 is comprised of a first shelf section 212 and a second shelf section 214 that are interconnected to one another to form a third shelf section 216, the first, second and third shelf sections 212, 214 and 216 forming a U-shaped shelf 218. The first, second and third shelf portions 212, 214 and 216 are each adjustable in their respective lengths and are supported by four adjustable legs 221-224. The legs 221-224 are each vertically adjustable to provide height adjustment of the U-shaped shelf 218 relative to a support surface upon which the legs 221-224 may rest. In this embodiment, each of the three shelf portions 212, 214 and 26 have a width W1, W2, and W3, respectively that are wider than the corresponding widths of the adjustable shelf 10 shown in FIG. 1. This allows for more and/or larger containers to be placed on and under the adjustable shelf 200, as may be desirable in larger cabinets, pantries and the like. In addition, each of the legs 221-224 are similarly configures and positioned proximate each of the four corners of the U-shaped shelf 218. The bottoms surfaces of each leg 221-224 are provided with rubber feet 221'-224' to prevent sliding of the adjustable shelf 200 on a surface upon which it is resting. The adjustable shelf 200 may be formed from molded plastic, wood, composite materials, or other appropriate materials, which will be known to those of skill in the art in light of the present disclosure.

Figure 8:
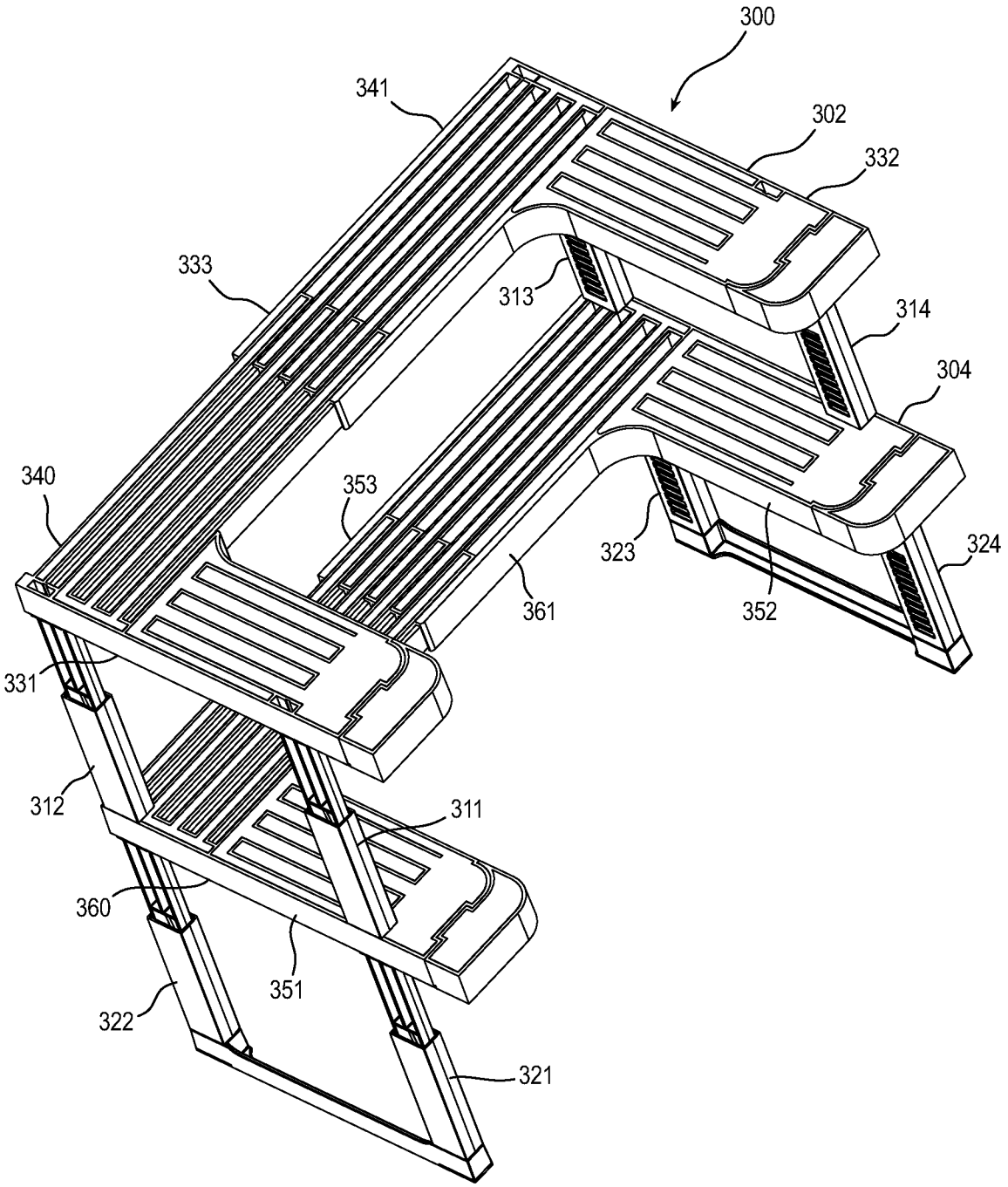
FIG. 8 is a perspective top side view of a third embodiment of an adjustable shelf according to the present invention.

As shown in FIG. 8, an adjustable shelf system, generally indicated at 300, is comprised of two stacked U-shaped shelves 302 and 304. Adjustable risers 311-314 are coupled to and between the shelves 302 and 304 and legs 321-324 are coupled to the shelf 304 to support it above a surface. The U-shaped shelf 302 is comprised of first, second and third shelf portions 331, 332 and 334 comprised of two interconnecting L-shaped sections 340 and 341. In this embodiment, shelf sections 331 and 332 are fixed in length and the shelf section 333 is adjustable in length. Similarly, the U-shaped shelf 304 is comprised of first, second and third shelf portions 351, 352 and 354 comprised of two interconnecting L-shaped sections 360 and 361. The shelf sections 351 and 352 are fixed in length and the shelf section 353 is adjustable in length. The interconnecting portions of the shelf sections 333 and 353 are configured similarly to the interconnecting portions of the L-shaped sections described with reference to FIG. 1 with the L-shaped section 340 including a plurality of fingers and the L-shaped section 341 including a plurality of channels for mating with the plurality of fingers in a slidable fashion. Thus, in this embodiment of the adjustable shelf 300 only the lengths of the back shelf sections 333 and 353 are adjustable.

Figure 9:
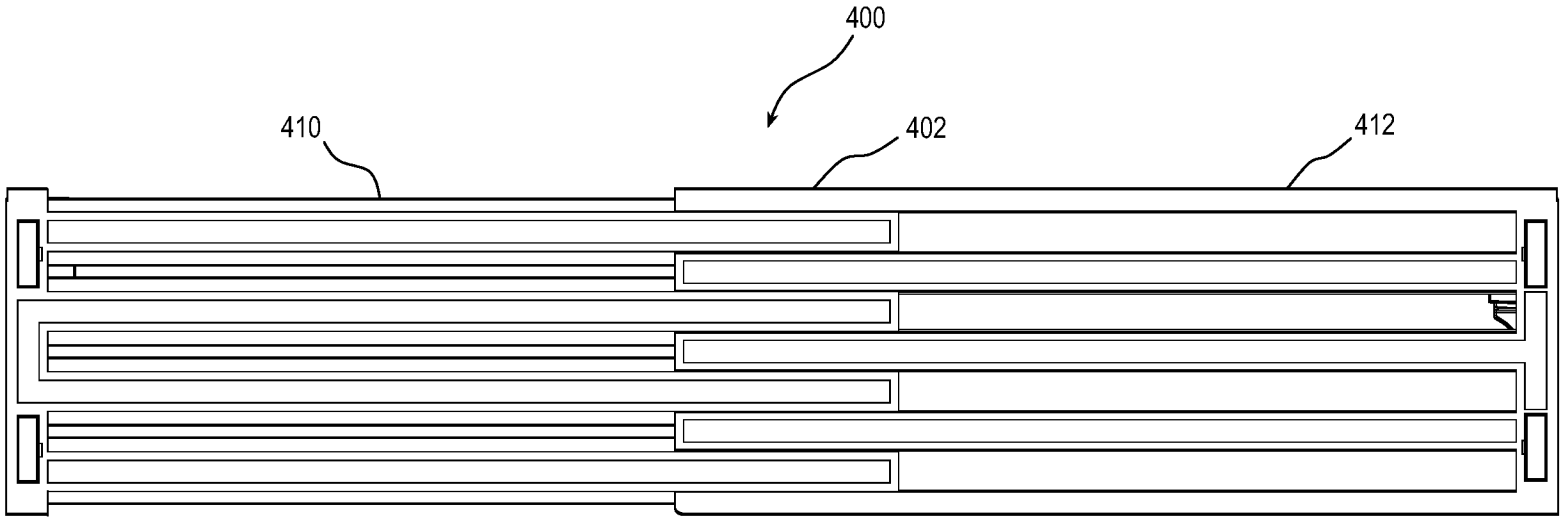
FIG. 9 is a top side plan view of a fourth embodiment of an adjustable shelf according to the present invention.

Finally, as shown in FIG. 9, an adjustable shelf, generally indicated at 300 is comprised of a single adjustable shelf section 402. The adjustable shelf 400 may include adjustable legs or risers attached to an underside thereof similar to those shown and described with reference to other embodiments herein. In this embodiment, the shelf section 402 is adjustable in length and includes two interconnected and slidably adjustable sections 410 and 412. The interconnecting portion of the shelf sections 410 and 412 are configured similarly to the interconnecting portions of the L-shaped sections described with reference to FIG. 1 with the shelf section 410 including a plurality of fingers and the shelf section 412 including a plurality of channels for mating with the plurality of fingers in a slidable fashion. Thus, in this embodiment of the adjustable shelf 400, only the length of the shelf section 402 is adjustable.

There is thus disclosed an improved adjustable shelf in which the basic and novel characteristics of the invention comprise in one embodiment a U-shaped shelf with the side shelves and shelf interposed therein between each being slidably adjustable in length to provide a U-shaped shelf capable of being configured in different widths and lengths. In other embodiments, only one shelf section may be adjustable. In the foregoing specification, the present invention has been described with reference to specific exemplary embodiments. Various modifications and changes may be made, however, without departing from the spirit and scope of the present invention as set forth in the claims, including combinations of elements of the various illustrated embodiments. The specification and figures are illustrative, not restrictive, and modifications are intended to be included within the scope of the present invention. Accordingly, the scope of the present invention should be determined by the claims and their legal equivalents rather than by merely the examples described.

For example, the components and/or elements recited in any apparatus claims may be assembled or otherwise operationally configured in a variety of permutations and are accordingly not limited to the specific configuration recited in the claims.

Benefits, other advantages, and solutions to problems have been described above with regard to particular embodiments. Any benefit, advantage, solution to problem, or any element that may cause any particular benefit, advantage, or solution to occur or to become more pronounced are not to be construed as critical, required, or essential features or components of any or all the claims.

The phrase "consisting essentially of" as may be used herein is intended to cover additional elements or functions that do not materially affect the basic and novel characteristics of the claimed invention. Thus, "consisting essentially of" is intended to encompass not only those components specifically listed, but also separate or additional components that do not materially alter the specifically recited functions or elements.

The terms "comprise", "comprises", "comprising", "having", "including", "includes" or any variations of such terms, are intended to reference a non-exclusive inclusion, such that a process, method, article, composition or apparatus that comprises a list of elements does not include only those elements recited but may also include other elements not expressly listed or inherent to such process, method, article, composition or apparatus. Other combinations and/or modifications of the above-described structures, arrangements, applications, proportions, elements, materials, or components used in the practice of the present invention, in addition to those not specifically recited, may be varied or otherwise particularly adapted to specific environments, manufacturing specifications, design parameters, or other operating requirements without departing from the general principles of the same.

What is claimed is:

1. An adjustable shelf system, comprising:

a first shelf section comprised of a first L-shaped portion having a first leg and a second leg and a first adjustable portion interconnected to the first leg of the first shelf section to form a first slidable connection, whereby sliding the first adjustable portion relative to the first leg of the first L-shaped portion adjusts a length of the first shelf section;

a second shelf section comprised of a second L-shaped portion having a first leg and a second leg and a second adjustable portion interconnected to the first leg of the second shelf section to form a second slidable connection, whereby sliding the second adjustable portion relative to the first leg of the second L-shaped portion adjusts a length of the second shelf section, the second leg of the first L-shaped portion interconnected to the second leg of the second L-shaped portion to form a third shelf section, whereby sliding the second leg of the first L-shaped portion relative to the second leg of the second L-shaped portion adjusts a length of the third shelf section, the first, second and third shelf sections together forming a U-shaped shelf; and a plurality of legs attached to an underside of the U-shaped shelf, each of the plurality of legs being adjustable in height;

wherein the first adjustable portion is comprised of a first base portion from which a first plurality of fingers depend and the first leg of the first L-shaped portion defines a first plurality of channels, each configured to receive one of the first plurality of fingers to form the first slidable connection when the first plurality of fingers are inserted into the first plurality of channels; and wherein a top surface of the first L-shaped portion, including top surfaces of each portion interposed between the plurality of channels, and a top surface of the first adjustable portion, including top surfaces of each of the first plurality of fingers, are planarly aligned.

2. The adjustable shelf system of claim 1, wherein the second adjustable portion is comprised of a second base portion from which a second plurality of fingers depend and the first leg of the second L-shaped portion defines a second plurality of channels, each configured to receive one of the second plurality of fingers to form the second slidable connection when the second plurality of fingers are inserted into the second plurality of channels.

3. The adjustable shelf system of claim 2, wherein the second leg of the first L-shaped portion defines a third plurality of channels and the second leg of the second L-shaped portion comprises a third plurality of fingers, the third plurality of channels each configured to receive one of the third plurality of fingers to form the third slidable connection when the third plurality of fingers are inserted into the third plurality of channels.

4. The adjustable shelf of claim 3, wherein a top surface of the first L-shaped portion, including top surfaces of each portion interposed between the third plurality of channels, and a top surface of the second L-shaped portion, including top surfaces of each of the third plurality of fingers, are planarly aligned.

5. The adjustable shelf of claim 3, wherein the first L-shaped portion includes a first base plate that forms a bottom of each of the first and third plurality of channels, each of the first and third plurality of channels being rectangular in shape and each sized to receive a respective finger of the first and third plurality of fingers.

6. The adjustable shelf of claim 5, wherein each of the plurality of first, second and third channels are formed by upwardly depending walls from a respective base plate and upper surface wall sections that define slots sized and shaped to receive a top portions of each respective on of the plurality of first, second and third fingers, such that a respective top surface of each of the upper surface wall sections and top surfaces of each of the top portions of respective fingers are substantially coplanar when the fingers are inserted into respective channels.

7. The adjustable shelf of claim 6, wherein each of the plurality of upper surface wall sections overhang one or more respective channels to define a plurality of slots between adjacent upper surface wall sections and each finger of the plurality of first, second and third fingers define stepped top portions, each stepped top portion configured to fit within a respective one of the plurality of slots so that top surfaces of the plurality of upper surface wall sections and of each of the plurality of first, second and third fingers define a substantially continuous surface along locations of finger to channel engagement.

8. The adjustable shelf of claim 7, wherein each of the plurality of first, second and third fingers are spaced apart and aligned in parallel to match a spacing and alignment of respective first, second and third channels.

9. The adjustable shelf of claim 3, wherein at least two of each of the first, second and third plurality of fingers include downwardly depending tabs at their respective distal ends, each tab configured to engage with a corresponding bottom slot in a corresponding channel so as to form a stop when the first, second and third fingers are retracted from respective first, second and third channels.

10. The adjustable shelf of claim 2, wherein a top surface of the second L-shaped portion, including top surfaces of each portion interposed between the second plurality of channels, and a top surface of the second adjustable portion, including top surfaces of each of the second plurality of fingers, are planarly aligned.

11. The adjustable shelf system of claim 1, wherein the first adjustable portion and the second adjustable portion are identically configured.

12. The adjustable shelf system of claim 1, wherein each of the plurality of legs are comprised of first and second leg portions, the first and second leg portions connected in a telescopic manner to allow adjustment of height of each of the plurality of legs.

13. The adjustable shelf system of claim 12, wherein a first leg of the plurality of legs is attached to an underside of the first adjustable portion, a second leg of the plurality of legs is attached to an underside of the second adjustable portion, a third leg of the plurality of legs is attached to an underside of the first L-shaped portion and a fourth leg of the plurality of legs is attached to an underside of the second L-shaped portion.

14. The adjustable shelf system of claim 12, wherein each of the first leg portions form a crescent shaped tube defining an opening within which a lower extending portion of each of the second leg portions is insertable.

15. The adjustable shelf system of claim 14, wherein each of the first leg portions include a self-biasing tab and each of the second leg portions include a plurality of evenly spaced and horizontally extending slots so that when the second leg portion is inserted into the first leg portion, retraction of the tab away from the second leg portion allows the first and second leg portions to slide relative to one another and releasing the tab allows the tab to engage with one of the plurality of slots such that the first leg portion is held to second leg portion by an engagement of the tab with the one of the plurality of slots.

16. The adjustable shelf of claim 1, wherein an upper end of each of the plurality of legs is configured to mate with the U-shaped shelf by sliding engagement, wherein an upper end of each leg includes a perimeter wall that extends above a top surface of the upper end, the perimeter wall defines a channel to receive a lip of a respective shelf portion to secure the respective shelf portion to the leg.

17. An adjustable shelf system, comprising:

a first shelf section comprised of a first L-shaped portion having a first leg and a second leg and a first adjustable portion interconnected to the first leg of the first shelf section to form a first slidable connection, whereby sliding the first adjustable portion relative to the first leg of the first L-shaped portion adjusts a length of the first shelf section; and a second shelf section comprised of a second L-shaped portion having a first leg and a second leg and a second adjustable portion interconnected to the first leg of the second shelf section to form a second slidable connection, whereby sliding the second adjustable portion relative to the first leg of the second L-shaped portion adjusts a length of the second shelf section, the second leg of the first L-shaped portion interconnected to the second leg of the second L-shaped portion to form a third shelf section, whereby sliding the second leg of the first L-shaped portion relative to the second leg of the second L-shaped portion adjusts a length of the third shelf section, the first, second and third shelf sections together forming a U-shaped shelf;

wherein the second adjustable portion is comprised of a second base portion from which a second plurality of fingers depend and the first leg of the second L-shaped portion defines a second plurality of channels, each configured to receive one of the second plurality of fingers to form the second slidable connection when the second plurality of fingers are inserted into the second plurality of channels;

wherein the second leg of the first L-shaped portion defines a third plurality of channels and the second leg of the second L-shaped portion comprises a third plurality of fingers, the third plurality of channels each configured to receive one of the third plurality of fingers to form the third slidable connection when the third plurality of fingers are inserted into the third plurality of channels; and wherein the first L-shaped portion includes a first base plate that forms a bottom of each of the first and third plurality of channels, each of the first and third plurality of channels being rectangular in shape and each sized to receive a respective finger of the first and third plurality of fingers.

18. The adjustable shelf system of claim 17, further comprising a plurality of legs attached to an underside of the U-shaped shelf, each of the plurality of legs being adjustable in height.

19. The adjustable shelf system of claim 18, wherein each of the plurality of legs are comprised of first and second leg portions, the first and second leg portions connected in a telescopic manner to allow adjustment of height of each of the plurality of legs.

20. The adjustable shelf system of claim 19, wherein a first leg of the plurality of legs is attached to an underside of the first adjustable portion, a second leg of the plurality of legs is attached to an underside of the second adjustable portion, a third leg of the plurality of legs is attached to an underside of the first L-shaped portion and a fourth leg of the plurality of legs is attached to an underside of the second L-shaped portion.

21. The adjustable shelf system of claim 20, wherein each of the first leg portions form a crescent shaped tube defining an opening within which a lower extending portion of each of the second leg portions is insertable.

22. The adjustable shelf system of claim 21, wherein each of the first leg portions include a self-biasing tab and each of the second leg portions include a plurality of evenly spaced and horizontally extending slots so that when the second leg portion is inserted into the first leg portion, retraction of the tab away from the second leg portion allows the first and second leg portions to slide relative to one another and releasing the tab allows the tab to engage with one of the plurality of slots such that the first leg portion is held to second leg portion by an engagement of the tab with the one of the plurality of slots.

23. The adjustable shelf of claim 22, wherein an upper end of each of the plurality of legs is configured to mate with the U-shaped shelf by sliding engagement, wherein an upper end of each leg includes a perimeter wall that extends above a top surface of the upper end, the perimeter wall defines a channel to receive a lip of a respective shelf portion to secure the respective shelf portion to the leg.

24. The adjustable shelf system of claim 17, wherein the second adjustable portion is comprised of a second base portion from which a second plurality of fingers depend and the first leg of the second L-shaped portion defines a second plurality of channels, each configured to receive one of the second plurality of fingers to form the second slidable connection when the second plurality of fingers are inserted into the second plurality of channels.

25. The adjustable shelf of claim 17, wherein a top surface of the first L-shaped portion, including top surfaces of each portion interposed between the plurality of channels, and a top surface of the first adjustable portion, including top surfaces of each of the first plurality of fingers, are planarly aligned.

26. The adjustable shelf of claim 25, wherein a top surface of the second L-shaped portion, including top surfaces of each portion interposed between the second plurality of channels, and a top surface of the second adjustable portion, including top surfaces of each of the second plurality of fingers, are planarly aligned.

27. The adjustable shelf of claim 17, wherein the first L-shaped portion includes a first base plate that forms a bottom of each of the first and third plurality of channels, each of the first and third plurality of channels being rectangular in shape and each sized to receive a respective finger of the first and third plurality of fingers.

28. The adjustable shelf of claim 27, wherein each of the plurality of first, second and third channels are formed by upwardly depending walls from a respective base plate and upper surface wall sections that define slots sized and shaped to receive a top portions of each respective on of the plurality of first, second and third fingers, such that a respective top surface of each of the upper surface wall sections and top surfaces of each of the top portions of respective fingers are substantially coplanar when the fingers are inserted into respective channels.

29. The adjustable shelf of claim 28, wherein each of the plurality of upper surface wall sections overhang one or more respective channels to define a plurality of slots between adjacent upper surface wall sections and each finger of the plurality of first, second and third fingers define stepped top portions, each stepped top portion configured to fit within a respective one of the plurality of slots so that top surfaces of the plurality of upper surface wall sections and of each of the plurality of first, second and third fingers define a substantially continuous surface along locations of finger to channel engagement.

30. The adjustable shelf of claim 17, wherein at least two of each of the first, second and third plurality of fingers include downwardly depending tabs at their respective distal ends, each tab configured to engage with a corresponding bottom slot in a corresponding channel so as to form a stop when the first, second and third fingers are retracted from respective first, second and third channels.

* * * * *